US009107023B2

(12) United States Patent
Ninan et al.

(10) Patent No.: US 9,107,023 B2
(45) Date of Patent: Aug. 11, 2015

(54) N SURROUND

(75) Inventors: Ajit Ninan, San Jose, CA (US); Deon Poncini, Santa Clara, CA (US); Gregory Buschek, San Jose, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 815 days.

(21) Appl. No.: 13/424,047

(22) Filed: Mar. 19, 2012

(65) Prior Publication Data

US 2012/0237037 A1 Sep. 20, 2012

Related U.S. Application Data

(60) Provisional application No. 61/454,135, filed on Mar. 18, 2011.

(51) Int. Cl.
*H04R 5/00* (2006.01)
*H04S 7/00* (2006.01)

(52) U.S. Cl.
CPC ..... *H04S 7/304* (2013.01); *H04S 2420/01* (2013.01)

(58) Field of Classification Search
CPC ..... H04S 7/304; H04S 2420/01; H04S 7/30; H04S 7/302
USPC ..... 381/17
See application file for complete search history.

(56) References Cited

U.S. PATENT DOCUMENTS

| | | | | |
|---|---|---|---|---|
| 4,199,658 | A | 4/1980 | Iwahara | |
| 5,272,757 | A | 12/1993 | Scofield | |
| 5,333,200 | A | 7/1994 | Cooper | |
| 5,459,790 | A | 10/1995 | Scofield | |
| 6,577,736 | B1 | 6/2003 | Clemow | |
| 2004/0105550 | A1 | 6/2004 | Aylward | |
| 2005/0226425 | A1 * | 10/2005 | Polk, Jr. | 381/17 |
| 2008/0273723 | A1 | 11/2008 | Hartung | |

FOREIGN PATENT DOCUMENTS

| | | |
|---|---|---|
| JP | 2001-025086 | 1/2001 |
| WO | 2008135049 | 11/2008 |

* cited by examiner

*Primary Examiner* — Paul S Kim

(57) ABSTRACT

Techniques are provided to use near-field speakers to add depth information that may be missing, incomplete, or imperceptible in far-field sound waves from far-field speakers, and to remove the multi-channel cross talk and reflected sound waves that otherwise may be inherent in a listening space with the far-field speakers alone. In some possible embodiments, a calibration tone may be monitored at each of a listener's ears. The calibration tone may be emitted by two or more far-field speakers. One or more audio portions from two or more near-field speakers may be outputted based on results of monitoring the calibration tone.

20 Claims, 4 Drawing Sheets

N SURROUND

CROSS-REFERENCE TO RELATED APPLICATIONS

This application claims priority to U.S. Provisional Patent Application No. 61/454,135 filed Mar. 18, 2011, which is hereby incorporated by reference for all purposes.

TECHNOLOGY

The present invention relates generally to audio processing, and in particular, to generating improved surround-sound audio.

BACKGROUND

In an environment in which original sounds are emanated from a variety of sound sources (e.g., a violin, a piano, a human voice, etc.), a listener may perceive a variety of audio cues related to directions and depths of the sound sources in the original sounds. These audio cues enable the listener to perceive/determine approximate spatial locations (e.g., approximately 15-20 feet away, slightly to the right) of the sound sources.

An audio system that uses fixed-position speakers to reproduce sounds recorded from original sounds typically cannot provide adequate audio cues that exist in the original sounds. This is true even if multiple speaker channels (e.g., left front, center front, right front, left back, and right back) are used. Such an audio system may reproduce only one or more directional audio cues, for example, by controlling relative sound output levels from the multiple speaker channels. Located in an optimal listening position relative to the configuration of the multiple speaker channels, the listener may be able to perceive, based on the directional audio cues in the reproduced sounds, from which direction a particular sound may likely come. However, the listener still will not experience a lively feeling of being in an environment in which the original sounds were emanated because the reproduced sounds still fail to adequately convey depth information of the sound sources to the listener. These problems may be exacerbated if the listening space is not ideal, but rather with sound reflections and multi-channel cross talk between different sound channels.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE POSSIBLE EMBODIMENTS

Figure 1A:
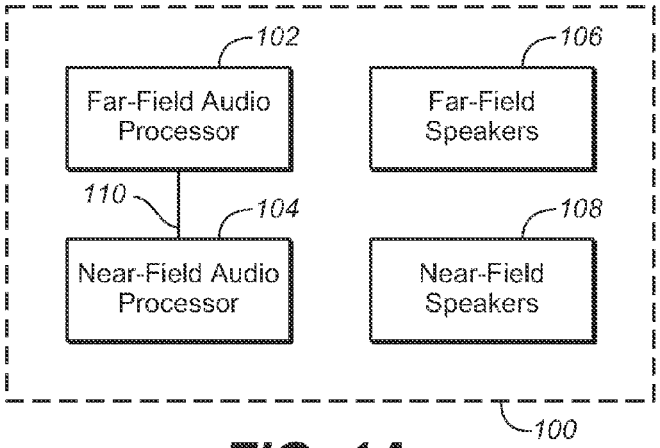
FIG. 1A illustrates an example audio processing system, in accordance with some possible embodiments of the present invention.

Example possible embodiments, which relate to audio processing techniques, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily including, obscuring, or obfuscating the present invention.

Example embodiments are described herein according to the following outline:

1. GENERAL OVERVIEW
2. AUDIO PROCESSING SYSTEM
3. MULTI-CHANNEL CROSS TALK REDUCTION/CANCELLATION
4. SURROUND (SOUND) RINGS
5. INTERPOLATION OPERATIONS BETWEEN SURROUND RINGS
6. MULTI-USER LISTENING SPACE
7. EXAMPLE PROCESS FLOW
8. IMPLEMENTATION MECHANISMS—HARDWARE OVERVIEW
9. EQUIVALENTS, EXTENSIONS, ALTERNATIVES AND MISCELLANEOUS

1. General Overview

This overview presents a basic description of some aspects of a possible embodiment of the present invention. It should be noted that this overview is not an extensive or exhaustive summary of aspects of the possible embodiment. Moreover, it should be noted that this overview is not intended to be understood as identifying any particularly significant aspects or elements of the possible embodiment, nor as delineating any scope of the possible embodiment in particular, nor the invention in general. This overview merely presents some concepts that relate to the example possible embodiment in a condensed and simplified format, and should be understood as merely a conceptual prelude to a more detailed description of example possible embodiments that follows below.

In some possible embodiments, far-field speakers may be placed at relatively great distances from a listener. For example, in a theater, far-field speakers may be placed around a listening/viewing space in which a listener is located. Since the far-field speakers are located at a much greater distance than a listener's inter-aural distance, sound waves from a speaker, for example, a left front speaker, may reach both the listener's ears in comparable strengths/levels, phases, or times of arrivals. The far-speakers may not be able to effectively convey audio cues based on inter-aural differences in strengths, phases, or times of arrivals. As a result, the far-field may only convey angular information of the sound source.

Aside from missing audio cues related to depth information, without techniques as described herein, the listener may hear multi-channel cross talk from the far-field speakers. For example, because of the relatively great distances between the far-field speakers and the listener, the listener's head may not act as an effective sound barrier to separate/distinguish sound waves of different far-field speakers. Sound waves from a left front audio channel at the relatively comparable distances to both ears may be easily heard by both the listener's ears, causing multi-channel cross talk from sound waves from other audio channels.

In addition, sound waves from far-field speakers may be reflected from surfaces and objects within and without a listening space. Besides sound waves propagated in a direct path from a far-field speaker to the listener, other sound waves of the same speaker/source may propagate in multiple non-direct paths, and may reach the listener in complex patterns. These reflected sound waves, combined with the multi-channel cross talk, may significantly compromise the angular information in the sound waves from the far-field speakers, and may significantly deteriorate the listening quality.

Under techniques described herein, an audio processing system may be configured to use near-field speakers to add depth information that may be missing, incomplete, or imperceptible in far-field sound waves from far-field speakers, and to remove the multi-channel cross talk and reflected sound waves that otherwise may be inherent in a listening space with the far-field speakers alone.

In some possible embodiments, the audio processing system may be configured to apply audio processing techniques including but not limited to a head-related transfer function (HRTF) to generate near-field sound waves and provide 3D audio cues including depth information in the sound waves to the listener. For example, the sound waves may comprise audio cues based on inter-aural differences in intensities/levels, phases, and/or times of arrivals, wherein some of the audio cues may be missing, weak, or imperceptible in far-field sound waves.

In some possible embodiments, microphones may be placed near a listener's ears to measure/determine multi-channel cross talk and reflected sound waves. In some possible embodiments, the results of the measurements of the multi-channel cross talk and reflected sound waves may be used to invert sound waves of the far-field speakers with levels proportional to the strength of the multi-channel cross talk and reflected sound waves, and to emit the inverted sound waves at one or more times determined by the time-wise characteristics of the multi-channel cross talk and reflected sound waves. The inverted sound waves may cancel/reduce the multi-channel cross talk and the reflected sound waves, resulting in much cleaner sound waves directed to the listener's ears.

Under techniques described herein, in addition to a surround ring formed by far-field sound waves, there may also be a new surround ring formed by near-field sound waves. In some possible embodiments, these two surround rings may be interpolated to create a plurality of surround rings. For example, volume levels of far-field speakers may increase while volume levels of near-field speakers may decrease, or vice versa. As will be explained later in more detail, special sound effects such as mosquito buzzing may be produced using some or all of the techniques as described herein.

Techniques described herein may be used to create sound effects that may not be local to a listener. For example, one or more near-field speakers in a multi-listener environment may emit sound waves that may be perceived by different users differently based on their respective distances to the one or more near-field speakers. Such sound effects as a phone ringing in the midst of the listening audience may be created under the techniques described herein.

In various possible embodiments, techniques described herein may be used in a wide variety of listening spaces with a wide range of different audio dynamics. For example, techniques described herein may be used to create a 3D listening experience in a 3D movie theater. A device (e.g., a wireless handheld device) near a listener that is either plugged into connector at a seat or is configured to communicate wirelessly may be used as a near-field audio processor to control near-field speakers disposed near the listener. Examples of such devices are, but not only limited to, various types of smart phones. A near-field audio processor may be implemented as an audio processing application running on a smart phone. The audio processing application may be downloaded to the smart phone, e.g., on-demand, automatically, or upon an event (e.g., when a user's presence is sensed at one of a plurality of locations in a theater). The smart phone comprises software and/or hardware components (e.g., DSP, ASIC, etc.) that the audio processing application uses to implement techniques as described herein. Microphones discussed above may be mounted in the listener's 3D glasses. Thus, techniques described herein may be relatively easily extended to a variety of environments and implemented by a variety of computing devices to enable a listener to enjoy a high quality 3D listening experience.

In some possible embodiments, mechanisms as described herein form a part of an audio processing system, including but not limited to a handheld device, game machine, theater system, home entertainment system, television, laptop computer, netbook computer, cellular radiotelephone, electronic book reader, point of sale terminal, desktop computer, computer workstation, computer kiosk, and various other kinds of terminals and processing units.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Audio Processing System

FIG. 1A illustrates an example audio processing system (100), in accordance with some possible embodiments of the present invention. In some possible embodiments, the audio processing system (100) may be implemented by one or more computing devices and may be configured with software and/or hardware components that implement image processing techniques for generating a wide dynamic range image based on at least two relatively low dynamic range images.

In some possible embodiments, the system (100) may comprise a far-field audio processor (102) configured to receive (e.g., multi-channel) audio data and to drive far-field speakers (106) in the system (100) to generate far-field sound waves based on the audio data.

For the purpose of the described embodiments of the invention, the far-field speakers (106) may be any software and/or hardware component configured to generate sound waves based on the audio data. In some possible embodiments, the far-field audio processor (100) may be provided by a theater system, a home entertainment system, a media computer based system, etc. Example of sound waves generated by the far-field speakers may be non-directional, directional, low frequency, high frequency, inaudible, ultrasonic, etc.

In some possible embodiments, the far-field speakers may comprise a plurality of speakers placed in a particular configuration (e.g., fixed, customized for an event, etc.). In some possible embodiments, the far-field speakers may be configured to convey angular information of sound sources in the sound image to a listener. As used herein, angular information may refer to one or more audio cues that may localize a portion of sound (e.g., a singer's voice) in the sound image as coming from a specific direction in relation to a listener.

In some possible embodiments, the far-field speakers may have no or limited ability to convey depth information in the sound image formed by the sound waves from the far-field speakers. As used herein, depth information may refer to one or more audio cues that may localize a portion of sound (e.g., a singer's voice) in the sound image as coming from a specific distance in relation to a listener.

In some possible embodiments, a listener herein may be within a particular space in relation to (e.g., near center to) the far-field speaker configuration. In some possible embodiments, the listener may be stationary. In some other possible embodiments, the listener may be mobile. In a multi-listener environment (e.g., a cinema, an amusement ride, etc.), each listener may be located in an individual space in the multi-listener environment.

In some possible embodiments, the system (100) may comprise a near-field audio processor (104) configured to receive (e.g., multi-channel) audio data and to drive near-field speakers (108) in the system (100) to generate a near-field sound waves based on the audio data. It should be noted that the near-field audio processor (104) may or may not be located spatially adjacent to the listener. In some possible embodiments, the near-field audio processor (104) may be a user device near the listener. In some possible embodiments, the near-field audio processor (104) may be located near the far-field audio processor (102) or may even be a part of the far-field audio processor (102).

For the purpose of the described embodiments of the invention, the near-field speakers (108) may be any software and/or hardware component configured to generate sound waves based on the audio data. In some possible embodiments, the near-field audio processor (100) may be provided by a theater system, an amusement ride sound system, a home entertainment system, a media computer based system, a handheld device, a directional sound system comprising at least two speakers, a small foot-print device, a device mounted on a pair of 3D glasses, a wireless communication device, a plug-in system near where a listener is located, etc. Example of sound waves generated by the near-field speakers may be non-directional, directional, low frequency, high frequency, inaudible, ultrasonic, etc.

In some possible embodiments, the near-field speakers may comprise a plurality of speakers placed in a particular configuration (e.g., fixed, customized for an event, etc.). In some possible embodiments, the near-field speakers may be configured to convey distance information of sound sources in the sound image to a listener. In some possible embodiments, the near-field speakers may be configured to convey angular information of sound sources in the sound image to a listener. In some possible embodiments, the near-field speakers may be configured to cancel or alter multi-channel cross talk audio portions from far-field sound waves relative to a listener.

In some possible embodiments, the near-field speakers may be placed close in relation to a listener. In some possible embodiments, the listener may wear a device or an apparatus that comprises the near-field speakers. In some other possible embodiments, the listener may be located in an individual space in the multi-listener environment and the near-field speakers may or may not be arranged in a specific configuration in the individual space.

In some possible embodiments, the system (100) may comprise one or more connections (110) that operatively link the far-field audio processor (102) and the near-field audio processor (104). In some possible embodiments, at least one of the connections (110) may be wireless. In some possible embodiments, at least one of the connections (110) may be wire-based. In some possible embodiments, audio data may be transmitted and/or exchanged between the far-field audio processor (102) and the near-field audio processor (104) through the connections (110). In some possible embodiments, control data and/or status data may be transmitted and/or exchanged between the far-field audio processor (102) and the near-field audio processor (104) through the connections (110). In some possible embodiments, applications and/or applets and/or application messages and/or metadata describing audio processing operations and/or audio data may be transmitted and/or exchanged between the far-field audio processor (102) and the near-field audio processor (104) through the connections (110).

In some possible embodiments, the audio processing system (100) may be formed in a fixed manner. For example, the components in the system (100) may be provided as a part of a theater system. In some other possible embodiments, the audio processing system (100) may be formed in an ad hoc manner. For example, when a listener situates in a theater, a mobile device which the listener carries may be used to download an audio processing application from the theater's audio processing system that controls the theater's speakers as far-field speakers; the mobile device may communicate with the theater's audio system via one or more wireless and/or wire-based connections and may control two or more near-field speakers near the listener. In some possible embodiments, the near-field speakers herein are plugged into or wirelessly connected to the mobile device with the audio processing application. The near-field speakers may be seat speakers (e.g., mounted around a seat on which the listener sits, speakers in a matrix configuration in a theater that are adjacent to the listener, etc.). Alternatively and/or equivalently, the near-field speakers may be headphones operatively connected to the mobile device. Alternatively and/or equivalently, the near-field speakers may be side speakers in a speaker configuration (e.g., a home theater) while other speakers in the speaker configuration constitute far-field speakers. Thus, different types of individual speakers may be used as the near-field speakers to add a 3D spatial sound field portion, to project a HRTF in the near-field sound waves and to cancel cross talks and reflections in the sound field for the purpose of the present invention. Examples of individual speakers herein include, but are not limited to, mobile speakers. The mobile speakers may be located in a matrix of speakers in the listening space as described herein. In some possible embodiments, the system (100) may be formed in an ad hoc manner, comprising the theater's system as the far-field audio processor, theater speakers as the far-field speakers, the mobile device as the near-field audio processor, and the near-field speakers near the listener.

3. Multi-Channel Cross Talk Reduction/Cancellation

Figure 1B:
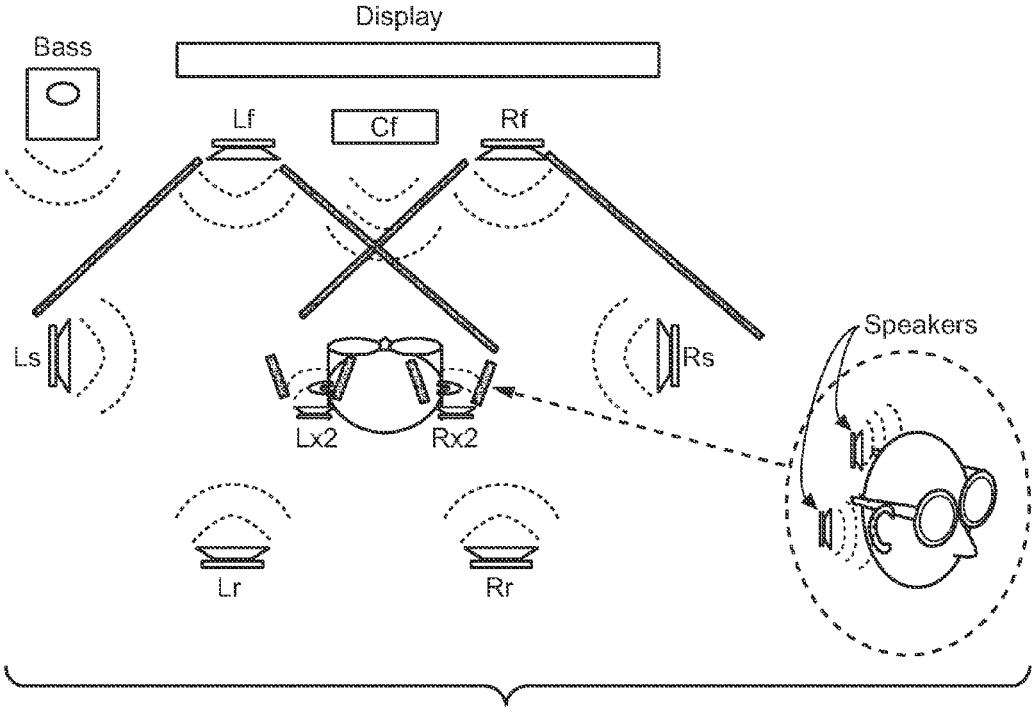
FIG. 1B illustrates an example speaker configuration of an audio processing system, in accordance with some possible embodiments of the invention.

FIG. 1B illustrates an example speaker configuration of an audio processing system (e.g., 100), in accordance with some possible embodiments of the invention. For the purpose of illustration, the audio processing system (100) may comprise far-field speakers—which may include a left front (Lf)

speaker, a center front (Cf), a right front (Rf) speaker, a bass speaker, a left side (Ls) speaker, a right side (Rs) speaker, a left rear (Lr) speaker, and a right rear (Rr) speaker—and near-field speakers—which may include a left near-field (Lx2) speaker and a right near-field (Rx2) speaker.

In some possible embodiments, the audio processing system (100) may be a part of a media processing system which may additionally and/or optionally be a part of a display (e.g., a 3D display). In some possible embodiments, the near-field speakers (Lx2 and Rx2) may be disposed near a listener. In some possible embodiments, additionally and/or optionally, the near-field speakers (Lx2 and Rx2) may be a part of a device local to the listener. For example, the listener may wear a pair of 3D glasses and the near-field speakers may be mounted on the 3D glasses. In some possible embodiments, the near-field speakers may be directional and may emit sounds audible to the listener only or to a limited space around the listener.

In some possible embodiments, the left front (Lf) speaker may emit left-side sound waves intended for the left-ear of the listener; however, the left-side sound waves may still be heard (as multi-channel cross talk) by the right-ear of the listener (e.g., via reflections off of walls or surfaces within a room, etc.). Likewise, the right front (Rf) speaker may emit right-side sound waves intended for the right-ear of the listener; however, the right-side sound waves may still be heard (as multi-channel cross talk) by the left-ear of the listener. Thus, multi-channel cross talk may be heard by the listener from front-field speakers.

In some possible embodiments, the audio processing system (100), or a near-field audio processor (104) therein, may create one or more sound wave portions to reduce/cancel the multi-channel cross talk from the far-field speakers. In some possible embodiments, the reduction/cancellation of multi-channel cross talk may create a better sound image as perceived by the listener and clarify/improve audio cues in the sound waves generated by the far-field speakers. In some possible embodiments, one or more right reduction/cancellation sound wave portions from the right near-field (Rx2) speaker may be used to cancel multi-channel cross talk from the left front (Lf) speaker, while one or more left reduction/cancellation sound wave portions from the left near-field (Lx2) speaker may be used to cancel multi-channel cross talk from the right front (Rf) speaker. In some possible embodiments, reduction/cancellation sound wave portions generated by the near-field speakers may result in sounds from front-field speakers with relatively high purity.

Techniques as described herein provide multi-channel cross talk reduction/cancellation directly at the ears of the listener, and create a better position-invariant solution, while some other techniques that add multi-channel cross talk reduction sound wave portions in far-field speakers do not reduce multi-channel cross talk effectively and provide only a position-dependent solution for multi-channel cross talk cancellation, as these other techniques require the listener to be located at a highly specific position in relation to a speaker configuration.

In some possible embodiments, unlike other techniques, multi-channel cross talk reduction techniques as described herein use microphones covariant with positions of the ears of the listener to accurately determine signal levels of multi-channel cross talk at the ears of the listener. Near-field sound wave portions to reduce/cancel the multi-channel cross talk may be generated based on the signal levels of multi-channel cross talk locally measured by the microphones, thereby providing a position-invariant multi-channel cross talk reduction/cancellation solution.

For example, small microphones may be located near the near-field speakers (Lx2 and Rx2) of FIG. 1B. The microphones may measure how much multi-channel cross talk is at each of the microphones. The near-field audio processor (104 of FIG. 1A) may receive audio data for one or more of the far-field speakers and determines, based on the audio data for the far-field speakers and the measured results of the multi-channel cross talk, how much reduction/cancellation sound wave portions to generate.

4. Surround (Sound) Rings

Figure 2A:
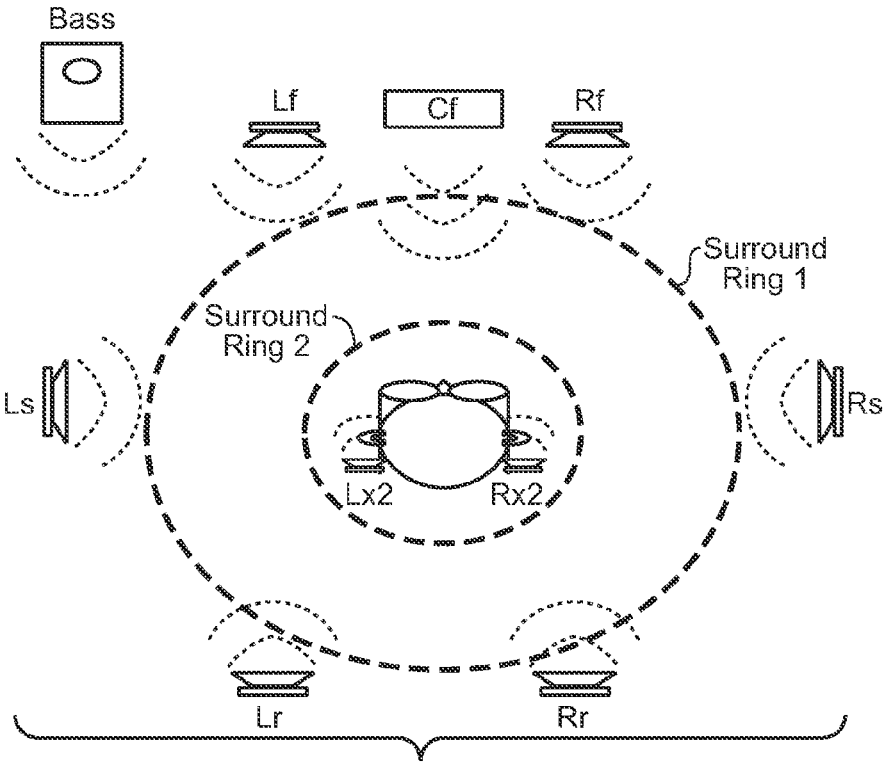
FIG. 2A illustrates example surround rings of an audio processing system formed by far-field and near-field speakers, in accordance with some possible embodiments of the present invention.

FIG. 2A illustrates example surround (sound) rings of an audio processing system (e.g., 100) formed by far-field and near-field speakers, in accordance with some possible embodiments of the present invention. As used herein, a surround ring may refer to a (e.g., partial) sound image created by sound waves from a set of speakers (e.g., a set of far-field speakers, a set of near-field speakers, etc.). In some possible embodiments, far-field sound waves from far-field speakers may create a surround ring 1, while near-field sound waves from near-field speakers may create a surround ring 2.

In some possible embodiments, a far-field sound image corresponding to surround ring 1 may comprise angular/directional information for sound sources whose sounds are to be reproduced in a listening space. All or some of the depth information for the sound sources may be missing in the far-field sound image. Because of the lack of depth image, the far-field sound image may not be able to provide a listener a feeling of being in the original environment in which the sound sources were emitting sounds. In some possible embodiments, one or more of the far-field speakers may be located at a relatively great distance (as compared with a diameter of the listener's inter-aural distance) from the listener. The sound waves from such far-field speakers may reach both ears in comparable intensity/levels and/or comparable phases and/or comparable times of arrivals. Each of the listener's ears may hear multi-channel cross talk from a channel of sound waves that is designated for the opposite ear, for example, in comparable intensity/levels and/or comparable phases and/or comparable times of arrivals.

Depending on the physical configuration and acoustic characteristics of the listening space, the far-field sound waves may be propagated to the listener's ears in multiple propagation paths. For example, the far-field sound waves may be reflected off one or more surfaces or objects in the listening space before reaching the listener's ears. In some possible embodiments, the listening space may be so configured or constructed as to significantly attenuate the reflected sound waves. In some other possible embodiments, the listening space may not be so configured or constructed to attenuate the reflected sound waves to any degree.

Because of the multi-channel cross talk and the multiple paths of the sound waves, if the listener listens to sounds solely from surround ring 1, the listener may have a relative low-quality listening experience.

In some possible embodiments, a near-field sound image corresponding to surround ring 2 may comprise both angular/directional information and depth information for sound sources whose sounds are to be reproduced in a listening space. In some possible embodiments, the near-field speakers may be situated relatively close to the listener's ears. In various possible embodiments, the near-field speakers may or may not be directly in the listener's ears. In some possible embodiments, the near-field speakers may be, but are not limited only to, directional. Because of the relative proximity to the listener's ears and/or directionality of the near-field speakers, audio processing techniques using a head-related transfer function (HRTF), such as those commercially available from Dolby Laboratories, Inc., San Francisco, Calif., may be applied to create a surround sound effect around the listener, and to help form a complementary and corrective surround ring (e.g., surround ring 2) relative to surround ring 1 from the far-field speakers. In some possible embodiments, these techniques may be used to provide audio cues to the listener in the near-field sound waves. The audio cues in the near-field sound waves may comprise audio cues that may be weak or missing in the far-field sound waves. The audio cues in the near-field sound waves may comprise sound (source) localization cues that enable the listener to perceive depth information related to the sound sources in the listening space. For example, one or more audio processing filters may be used to generate inter-aural level difference, inter-aural phase difference, inter-aural time difference, etc., in the near-field sound waves directed to the listener's ears.

It should be noted that the surround rings depicted in FIG. 2A are for illustration purposes only. For the purpose of the described embodiments of the invention, the depth information and/or sound localization in the near-field sound waves may allow the listener to perceive/differentiate sound sources from close to the listener to sound sources near the far-field speakers or even beyond.

Because of the addition of depth information and/or sound localization cues, a combination of the far-field sound image and the near-field sound image may be used to provide the listener a feeling of being in the original environment in which the sound sources were emitting sounds.

In some possible embodiments, a far-field audio processor that controls the far-field speakers and a near-field audio processor that controls the near-field speakers may be (time-wise) synchronized and/or transmit/exchange audio data and/or transmit/exchange calibration signals, etc. In some possible embodiments, intercommunications between two audio processors may be avoided if the same audio processor is used to control both the far-field speakers and the near-field speakers. In some other possible embodiments in which the far-field audio processor and the near-field audio processor are separate, the audio processors may be synchronized and/or transmit/exchange audio data and/or transmit/exchange calibration signals, etc., either in-band or out-of-band, either wirelessly or with wire-based connections. The intercommunications herein between the audio processors may use electromagnetic waves, electric currents, audible or inaudible sound waves, light waves, etc. Any, some, or all of the intercommunications herein between the audio processors may be performed automatically, on-demand, periodically, event-based, at one or more time points, when the listener moves to a new listening position, etc.

In some possible embodiments, a device in the listener's proximity or possession such as a wireless device may be used as the near-field audio processor. At the time the listener situates in the listening space, the listener's wireless device may download an application/applet/plug-in software package wirelessly. The downloaded application/applet/plug-in software package may be used to configure software and/or hardware (e.g., DSP) on the wireless device into the near-field audio processor that works cooperatively with the far-field audio processor, for example, in a theater system.

In some possible embodiments, microphones may be mounted near the listener's ears to detect multi-channel cross talk from the far-field speakers. Any one of different methods of detecting multi-channel cross talk may be used for the purpose of the possible embodiments of the invention. In some possible embodiments, the near-end audio processor may receive audio data (e.g., wirelessly or wire-based) for each of the audio channels of the far-end speakers, and may be configured to determine multi-channel cross talk based on the audio data received and the far-field sound waves as detected by the microphones.

In some possible embodiments, the far-end audio processor may be configured to generate a calibration tone from the far-end speakers. The calibration tone may be audible or inaudible sound waves, for example, above a sound wave frequency threshold for human aural perception. In some possible embodiments, the calibration tone may comprise a number of component calibration tones. In some embodiments, different component calibration tones in the calibration tone may be emitted by different far-end speakers, for example, in a particular order (e.g., sequential, round-robin, on-demand, etc.). In an example, a first one of the far-end speakers may emit a first component calibration tone at a first time (e.g., t0), a second one of the far-end speakers may emit a second component calibration tone at a second time (e.g., t0+a pre-configured time delay such as 2 seconds), and so on. As used herein, a component calibration tone herein may be, but is not limited only to, a pulse, a sound waveform of a relatively short time duration, a group of sound waves with certain time-domain or frequency-domain profiles, with or without modulation of digital information, etc.

In some possible embodiments, the audio processing system (100) may be configured to use the microphones in the listener's proximity to measure the intensity/levels, phases, and/or times of arrivals of the component calibration tones in the calibration tone at each of the listener's ears. The audio processing system (100) may be configured to compare the measurement results of the microphones at each of the listener's ears, and determine the audio characteristics of sound waves from any of the far-field speakers.

In some possible embodiments, a first component calibration tone is emitted out of a first speaker (e.g., Lf). The first component calibration tone is received at a first time delay by a microphone located (e.g., near the right ear) in the listener's proximity. The first time delay of the component calibration tone may be recorded in memory. In some possible embodiments, the first component calibration tone is known or scheduled to occur at a first emission time (e.g., 2 seconds from a reference time such as the completion time of the synchronization between the far-field and near-field audio processors; repeated every minute). Thus, the first time delay at the microphone may simply be determined as the differences between a first arrival time (e.g., 2.1 seconds from the same reference time) of the first component calibration tone at the microphone and the first emission time. In this example, the first time delay between the first speaker (Lf) and the microphone (at or near the right ear) is determined as 0.1 second. To cancel the cross talk from the first speaker (Lf) at the right ear, based on the same audio signal that causes the first speaker to emit sound waves at a time t, inverted sound waves may be emitted from a near-field right speaker at the first time delay from the time t at the right ear. The magnitude or level of the inverted sound waves may be set in proportion to the strength of the cross talk sound waves from the first speaker (Lf) as measured by the microphone.

Similarly, a second component calibration tone is emitted out of a second speaker (e.g., Rf). The second component calibration tone is received at a second time delay by a microphone located (e.g., near the left ear) in the listener's proximity. The second component calibration tone is known or scheduled to occur at a second emission time (e.g., 3 seconds from the reference time). Thus, the second time delay at the microphone may simply be determined as the differences between a second arrival time (e.g., 3.2 seconds from the same reference time) of the second component calibration tone at the microphone and the second emission time. In this example, the second time delay between the second speaker (Rf) and the microphone (at or near the left ear) is determined as 0.2 seconds. To cancel the cross talk from the second speaker (Rf) at the left ear, based on the same audio signal that causes the second speaker to emit sound waves at a time t, inverted sound waves may be emitted from a near-field left speaker at the second time delay from the time t at the left ear. The magnitude or level of the inverted sound waves may be set in proportion to the strength of the cross talk sound waves from the second speaker (Rf) as measured by the microphone.

The foregoing calibration process may be used to measure time delays for reflected sound waves for each of the far-field speakers. For example, a sound wave peak with a profile matching the first component calibration tone from the first speaker (Lf) may occur not only at 2.1 seconds after the reference time, but also at 2.2 seconds, 2.3 seconds, etc. Those longer delays may be determined as reflected sound waves. Inverted sound waves may be emitted to cancel reflected sound waves at each of the listener's ears, based on the time delays and the strengths of the reflected sound waves.

The foregoing calibration process may be repeated for each of the far-field speakers. As described herein, synchronizing the far-field and near-field audio processors and/or setting a common time reference may be signaled or performed out of band.

For the purpose of illustration only, the calibration process has been described as measuring emissions of component calibration tones from the far-field speakers in a time sequence. For the purpose of the present invention, other ways of performing calibration processes may be used. For example, component calibration tones may be sent using different sound wave frequencies. The component calibration tones may be sent in synchronized, sequential, or even random times in various possible embodiments.

For the purpose of illustration, the calibration process has been described as using a common reference time. For the purpose of the present invention, some possible embodiments do not use a common reference time. For example, as long as the time gaps between different far-field speakers are known, time delays of the far-field speakers at a particular microphone may be determined (e.g., through correlation, through triangulation, etc.). For example, the time sequence (e.g., any start time+2 seconds for a first speaker, +3 seconds for a second speaker, +5 seconds for a third speaker; note the time gap between the first speaker and the second speaker is set to be one second, while the time gap between the second speaker and the third speaker is set to be two seconds) formed by the emission times of different component calibration tones from different far-field speakers with known time gaps may be compared with the time sequence (e.g., any start time+2.1 seconds, any start time+3.2 seconds, any start time+5.3 seconds) formed by the arrival times of the different component calibration tones at a microphone. This comparison may be used to determine time delays (0.1 second for the first speaker, 0.2 second for the second speaker, etc.) from the far-field speakers, respectively.

In some possible embodiments, the measurement results of the microphones may be used to determine/deduce audio properties/characteristics of multi-channel cross talk. For example, the measurement results of the microphones may indicate that a component calibration tone emitted from the left front (Lf) speaker has a certain intensity/level, phase, and/or time of arrival at the listener's left ear but has a different intensity/level, phase, and/or time of arrival at the listener's right ear. The audio processing system (100) may compare these measurement results and determine the difference or ratio of various audio properties (e.g., intensity/level, phase, time of arrival, etc.) between the left front sound waves propagated to the listener's left ear and the left front sound waves propagated to the listener's right ear.

In some possible embodiments, the measurement results of the microphones may be used to determine/deduce audio properties/characteristics of reflected sound waves. For example, the measurement results of the microphones may indicate that a component calibration tone emitted from the left front (Lf) speaker has a sequence of signal peaks each of the signal peaks may correspond to one of multiple propagation paths. The measurement results of the microphones may indicate, for one or more (e.g., the most significant ones) of the multiple propagation paths, certain intensity/level, phase, and/or time of arrival at each of the listener's ears. The audio processing system (100) may compare between these different propagation paths and determine the difference or ratio of various audio properties (e.g., intensity/level, phase, time of arrival, etc.) between the far-field sound waves directly propagated to the listener's left ear (e.g., the first peak) and the far-field sound waves linked to any other propagation paths.

In some possible embodiments, the audio processing system (100) may be configured to reduce/cancel multi-channel cross talk. For example, based on the audio properties/characteristics of multi-channel cross talk related to a particular audio channel, the audio processing system (100) may generate one or more multi-channel cross talk reduction/cancellation (sound wave) portions in the near-field sound waves to reduce/cancel multi-channel cross talk in far-field sound waves. The multi-channel cross talk reduction/cancellation portions may be obtained by inverting the sound waves of the far-field sound waves. The intensity/level of the multi-channel cross talk reduction/cancellation portions may be proportional (or inversely proportional depending how a ratio is defined) to a ratio (e.g., in a non-logarithmic domain) or difference (e.g., in a logarithmic domain) of intensities/levels between the sound waves in the non-designated ear and the sound waves in the designated ear. In addition, the phase and/or the time of arrival of the multi-channel cross talk reduction/cancellation portions may be set based on the audio properties/characteristics of the multi-channel cross talk as determined, to effectively reduce/cancel the multi-channel cross talk.

In some possible embodiments, the audio processing system (100) may be configured to reduce/cancel sound reflections. For example, based on the audio properties/characteristics of reflected sound waves related to a particular audio channel and a particular propagation path, the audio processing system (100) may generate one or more reflection reduction/cancellation (sound wave) portions in the near-field sound waves to cancel/reduce the reflected sound waves in far-field sound waves. The reflection reduction/cancellation portions may be obtained by inverting the sound waves of the far-field sound waves that are associated with a direct propagation path. The intensity/level of the reflection reduction/cancellation portions may be proportional (or inversely proportional depending how a ratio is defined) to a ratio (e.g., in a non-logarithmic domain) or difference (e.g., in a logarithmic domain) of intensities/levels between the sound waves in a non-direct propagation path and the sound waves in the direct propagation path. In addition, the phase and/or the time of arrival of the multi-channel cross talk reduction/cancellation portions may be set based on the audio properties/characteristics of the reflected sound waves as determined for the non-direct propagation path, to effectively reduce/cancel the reflected sound waves.

Thus, techniques as described herein may be used to reduce/cancel the multi-channel cross talk and the reflected sound waves in the far-field sound image generated by the far-field speakers. Consequently, the listener may have a relative high-quality listening experience.

In some possible embodiments, additionally and/or optionally, the position and orientation of a listener's head may be tracked. The head tracking can be done in multiple ways not limited to using tones and pulses. In some possible embodiments, the head tracking may be done such that distances and/or angles to speakers (e.g., the near field speakers and/or the far-field speakers) may be determined. The head tracking may be performed dynamically, from time to time, or continuously and may include tracking head turns by the listeners. The result of head tracking may be used to adjust one or more speakers' outputs including one or more audio characteristics of the speakers' outputs. The one or more speakers here may include headphones worn by, and thus moving with the head of, the listener. The audio characteristics adjusted may include angular information, HRTF, etc. projected to the listener. In some possible embodiments, adjusting the speakers' outputs based on the result of head tracking localizes the sound effects relative to the listener as if the listener were in a realistic 3D space with the actual sound sources. In some possible embodiments, adjusting the speakers' outputs based on the result of head tracking produces an effect such that the sound sources portrayed in the sound image is stationary in space relative to the listener (e.g., the listener may rotate his head search for a sound source and the sound source may appear stationary relative to the listener and not affected by the listener's head rotation even if headphones worn by the listener constitute a part or whole of the near-field speakers).

5. Interpolation Operations Between Surround Rings

Figure 2B:
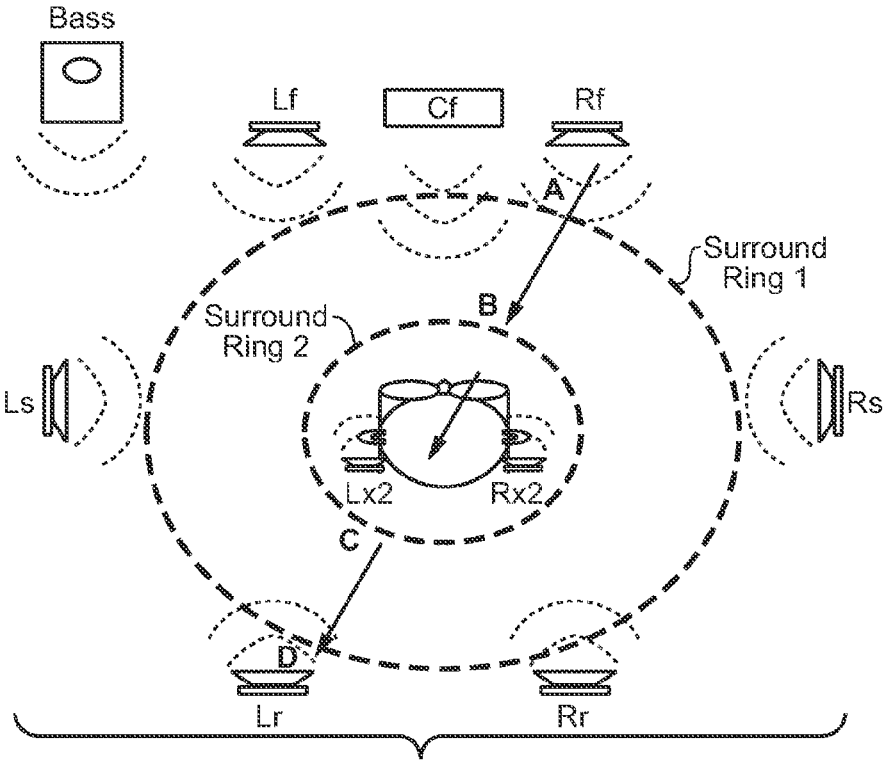
FIG. 2B illustrates example interpolation operations of an audio processing system (e.g., 100) between surround rings, in accordance with some possible embodiments of the present invention.

FIG. 2B illustrates example interpolation operations of an audio processing system (e.g., 100) between surround rings (e.g., 1 and 2 of FIG. 2A), in accordance with some possible embodiments of the present invention.

In some possible embodiments, far-field sound waves and near-field sound waves may be interpolated to effectively create a number of inner surround rings other than surround rings 1 and 2. In some possible embodiments, the audio processing system (100) may be configured to receive/interpret sound localization information embedded in audio data. The sound localization information may include, but is not limited to, depth information and angular information related to various sound sources whose sound waves are represented in the audio data. In some possible embodiments, the audio processing system (100) may interpolate near-field sound waves with far-field sound waves based on the sound localization information. For example, to depict buzzing sounds from a mosquito flying from point A to point D, the audio processing system (100) may be configured to cause the right front (Rf of FIG. 1A) speaker to emit more of the buzzing sounds and the right near-field (Rx2 of FIG. 1A) speaker to emit less of the buzzing sounds when the mosquito is depicted at point A. The audio processing system (100) may be configured to cause the right front (Rf of FIG. 1A) speaker to emit less of the buzzing sounds and the right near-field (Rx2 of FIG. 1A) speaker to emit more of the buzzing sounds when the mosquito is depicted at point B. The audio processing system (100) may be configured to cause the left rear (Lr of FIG. 1A) speaker to emit less of the buzzing sounds and the left near-field (Lx2 of FIG. 1A) speaker to emit more of the buzzing sounds when the mosquito is depicted at point C. The audio processing system (100) may be configured to cause the left rear (Lr of FIG. 1A) speaker to emit more of the buzzing sounds and the left near-field (Lx2 of FIG. 1A) speaker to emit less of the buzzing sounds when the mosquito is depicted at point D. Thus, techniques as described herein may be used to render an accurate overall sound image in which one or more sound sources may be moving around the listener. In some possible embodiments, these techniques may be combined with 3D display technologies to provide a superior audiovisual experience to a viewer/listener.

6. Multi-User Listening Space

Figure 3:
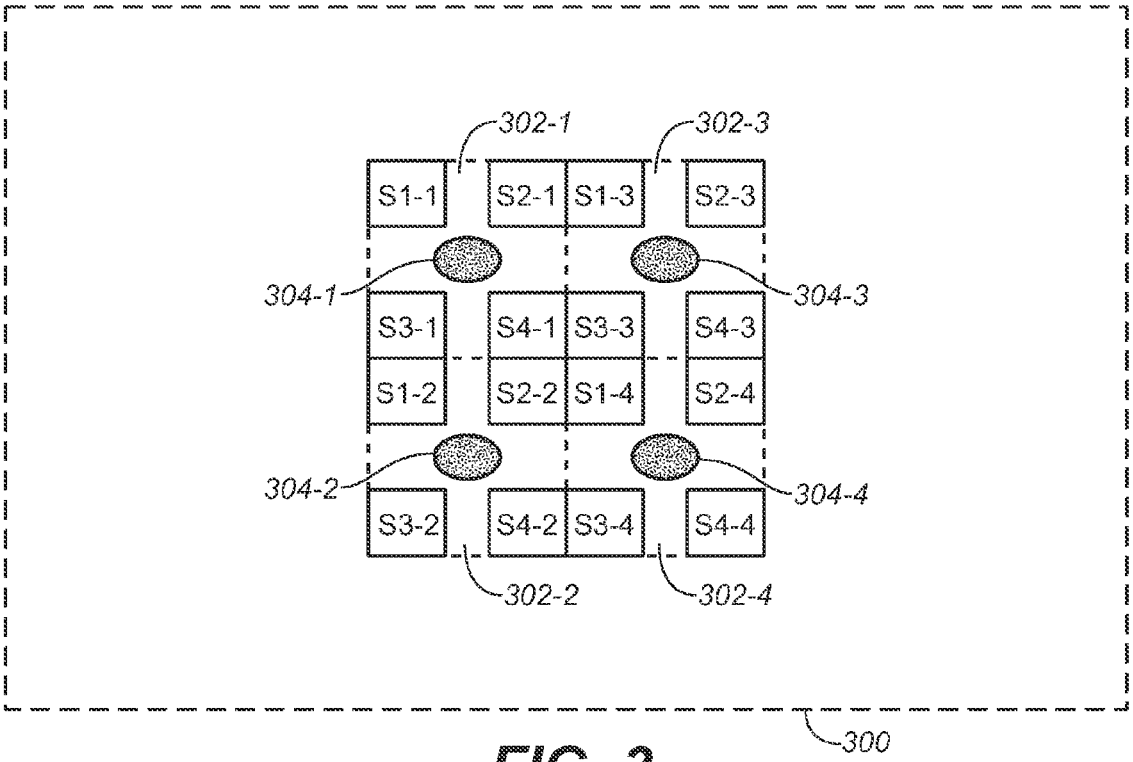
FIG. 3 illustrates an example multi-user listening space, in accordance with some possible embodiments of the invention.

FIG. 3 illustrates an example multi-user listening space (300), in accordance with some possible embodiments of the invention. In some possible embodiments, the multi-user listening space (300) may comprise a plurality of listening subspaces (e.g., 302-1, 302-2, 302-3, 302-4, etc.). Some of the plurality of listening subspaces may be occupied by a listener (304-1, 304-2, 304-3, 304-4, etc.). It should be noted that not all of the listening subspaces need to be occupied. It should also be noted that the number of near-field speakers may be two in some possible embodiments, but may also be more than two in some other possible embodiments.

In some possible embodiments, a listener may be configured with a number of speakers. For example, listener 304-1 may be assigned speakers S1-1, S2-1, S3-1, S4-1, etc.; listener 304-2 may be assigned speakers S1-2, S2-2, S3-2, S4-2, etc.; listener 304-3 may be assigned speakers S1-3, S2-3, S3-3, S4-3, etc.; listener 304-4 may be assigned speakers S1-4, S2-4, S3-4, S4-4, etc. Some or all of these speakers may be used as near-field speakers under techniques herein.

In some possible embodiments, an audio processing system (e.g., 100 of FIG. 1A) as described herein may be configured to use near-field speakers with each listener to cancel multi-channel cross talk from other listeners' sound waves. The cancellation of multi-channel cross talk from the other listeners' multi-channel cross talk may be performed in a manner similar to how the cancellation of multi-channel cross talk from far-field speakers is performed, as discussed above.

As discussed above, in some possible embodiments, techniques as described herein may be used to operate far-field speakers and a listener's near-field speakers to provide sound localization information to the listener. This may be similarly done for all of the listeners in different subspaces in the listening space (300).

In some possible embodiments, techniques described herein may be used to operate more than one listener's near-field speakers to collectively create additional three-dimensional sound effects. In some possible embodiments, some sound wave portions generated by one or more of a listener's near-field speakers may be heard by other listeners without multi-channel cross talk cancellation. For example, the audio processing system may be configured to control the far-field speakers and all the listeners' near-field speakers. One or more of the near-field speakers in the set of all the listeners' near-field speakers may be directed by the audio processing system (100) to produce certain sounds, while other listeners' near-field speakers may be directed by the audio processing system (100) not to cancel/reduce the certain sounds. The certain sounds here, for example, may be a wireless phone's ring tone. The ring tone in the midst of the listeners may be used to provide a realistic in-situ feeling in some circumstances. Thus, techniques as described herein not only may be used to create additional surround rings local to a listener, but may also be used to create complex sound images other than those formed by the rings personal to an individual listener.

In some possible embodiments, bass speakers may be placed in the listening space in which one or more listeners may be located. In some possible embodiments, an audio processing system (e.g., 100) may be configured to control the bass speakers to generate low frequency sound waves.

Sound effects such as approaching thunderstorms or explosions may be simulated by the successive emission of low-frequency sound waves (booming sounds), through the listening space, from a sequence or succession of bass speakers.

For the purpose of the present invention, near-field speakers herein may refer to speakers mounted near the listener in some possible embodiments, but may also refer to any speakers that are situated relatively close to the listener in some other possible embodiments. For example, in some possible embodiments, near-field speakers herein may be located one or more feet away, and may be used to generate near-field sound waves having the properties discussed above.

7. Example Process Flow

Figure 4:
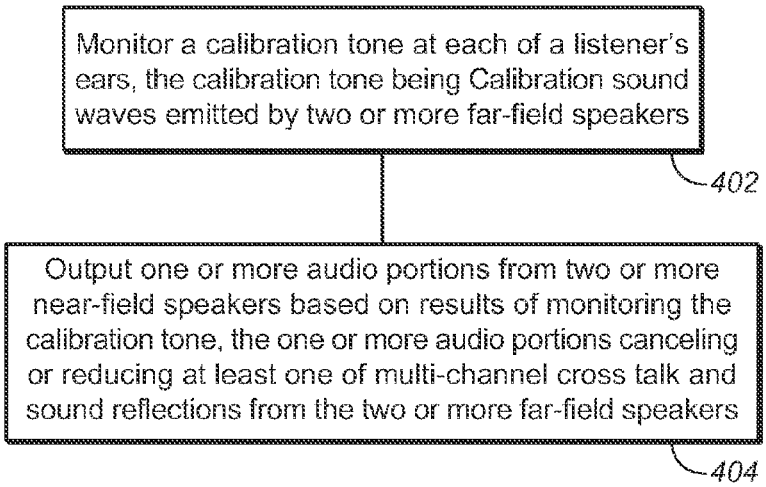
FIG. 4 illustrates an example process flow, according to a possible embodiment of the present invention.

FIG. 4A illustrates an example process flow according to a possible embodiment of the present invention. In some possible embodiments, one or more computing devices or components such as an audio processing system (e.g., 100) may perform this process flow. In block 402, the audio processing system (100) may monitor a calibration tone at each of a listener's ears. The calibration tone may be calibration sound waves emitted by two or more far-field speakers.

In some possible embodiments, the calibration tone may comprise sound waves at high sound wave frequencies beyond human hearing. In some possible embodiments, the calibration tone may comprise a plurality of pulses emitted by different ones of the far-end speakers at a plurality of specific times.

In block 404, the audio processing system (100) may output one or more audio portions from two or more near-field speakers based on results of monitoring the calibration tone. The one or more audio portions cancels or reduces at least one of multi-channel cross talk and sound reflections from the two or more far-field speakers.

In some possible embodiments, the far-field speakers and the near-field speakers may be controlled by a common audio processor. In some possible embodiments, the far-field speakers may be controlled by a far-field audio processor, while the near-field speakers may be controlled by a near-field audio processor. In some possible embodiments, the audio processing system (100) may synchronize the near-field audio processor with the far-field audio processor. Synchronizing herein may be performed at one of a start of an audio listening session by the listener, one or more specific time points in the audio listening session, or at one of the listener's inputs in the audio listening session.

In some possible embodiments, the near-field audio processor and the far-field audio processor may be synchronized out of band. In some possible embodiments, the near-field audio processor and the far-field audio processor may be synchronized wirelessly.

In some possible embodiments, the audio processing system (100) may apply a signal processing algorithm to generate a surround ring that is separate from another surround-sound ring generated by the far-field speakers. The signal processing algorithm may be a part of an application downloaded to a device in the listener's proximity.

In some possible embodiments, the monitoring of the calibration tone may be in part performed by two or more microphones mounted in the listener's proximity. The microphones are mounted on a pair of glasses worn by the listener.

In some possible embodiments, the audio processing system (100) may determine, based on the monitoring of the calibration tone, one or more audio properties of far-field sound waves from the far-field speakers. The one or more audio properties may comprise at least one of inter-aural level difference, inter-aural intensity difference, inter-aural time difference, or inter-aural phase difference.

In some possible embodiments, the audio processing system (100) may determine, based on the one or more audio properties of far-field sound waves from the far-field speakers, multi-channel cross talk and sound reflections related to a far-field sound waves. In some possible embodiments, the far-field speakers may not be configured to inject sound wave portions to cancel or reduce multi-channel cross talk. In some possible embodiments, the audio processing system (100) may cancel or reduce at least one of multi-channel cross talk and sound reflections by outputting near-field sound waves obtained by inverting sound waves in the far-field sound waves.

In some possible embodiments, the near-field sound waves may comprise at least one, two, or more audio cues indicating at least one distance of a sound source other than the far-field speakers, and wherein none of the at least one, two, or more audio cues are detectable from the far-field sound waves.

In some possible embodiments, the near-field sound waves may comprise at least one, two, or more audio cues indicating at least one distance of a sound source other than the far-field speakers; one of the at least one, two, or more audio cues is not detectable from the far-field sound waves. In some possible embodiments, the near-field sound waves may comprise at least one, two or more audio cues based on at least one of inter-aural phase difference, inter-aural time difference, inter-aural level difference, or inter-aural intensity difference.

In some possible embodiments, the near-field sound waves may comprise at least one, two or more sound localization audio cues.

In some possible embodiments, the near-field sound waves may comprise at least one, two or more audio cues generated with one or more audio processing filters using a head-related transfer function.

In some possible embodiments, the near-field sound waves may be based at least in part on audio data generated with a binaural recording device.

In some possible embodiments, the near-field audio processor may receive, for example, wirelessly or through a wired connection to the audio processing system (100), at least a part of audio data, control data, or metadata to drive the near-field speakers.

In some possible embodiments, the audio processing system (100) may provide one or more user controls on a device, which may, for example, comprise the near-field audio processor; the one or more user controls may allow the listener to control at least one of synchronizing with the far-field audio processor or downloading an audio processing application on demand.

In some possible embodiments, the audio processing system (100) may interpolate near-field sound waves with the far-field sound waves to form a surround ring that is different from both a surround ring generated by the near-field speakers and a surround ring generated by the front-field speakers.

In some possible embodiments, at least one of the near-field speakers and the far-field speakers is one of a directional speaker or a non-directional speaker.

8. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 5:
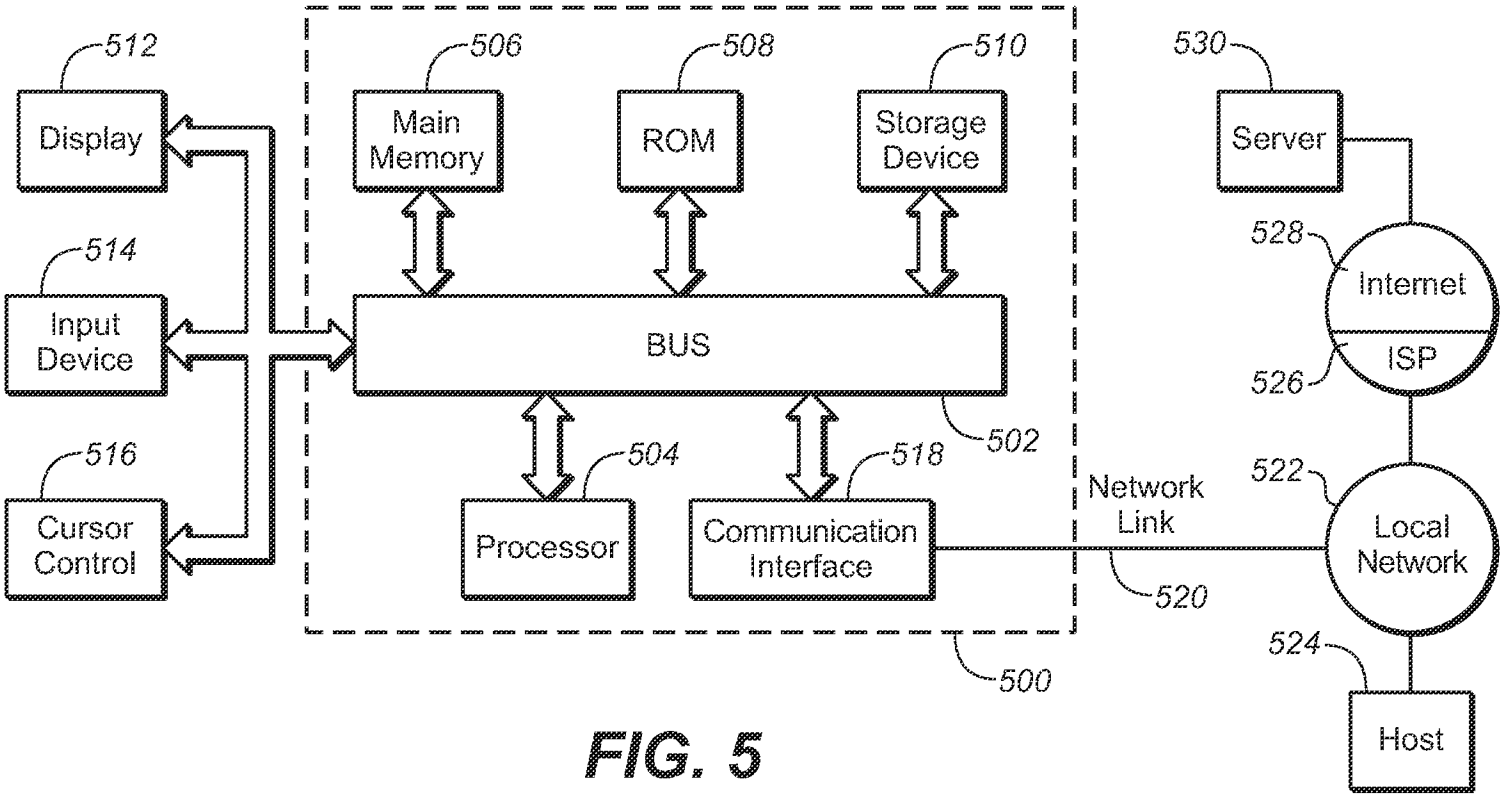
FIG. 5 illustrates an example hardware platform on which a computer or a computing device as described herein may be implemented, according a possible embodiment of the present invention.

For example, FIG. 5 is a block diagram that illustrates a computer system 500 upon which an embodiment of the invention may be implemented. Computer system 500 includes a bus 502 or other communication mechanism for communicating information, and a hardware processor 504 coupled with bus 502 for processing information. Hardware processor 504 may be, for example, a general purpose microprocessor.

Computer system 500 also includes a main memory 506, such as a random access memory (RAM) or other dynamic storage device, coupled to bus 502 for storing information and instructions to be executed by processor 504. Main memory 506 also may be used for storing temporary variables or other intermediate information during execution of instructions to be executed by processor 504. Such instructions, when stored in non-transitory storage media accessible to processor 504, render computer system 500 into a special-purpose machine that is customized to perform the operations specified in the instructions.

Computer system 500 further includes a read only memory (ROM) 508 or other static storage device coupled to bus 502 for storing static information and instructions for processor 504. A storage device 510, such as a magnetic disk or optical disk, is provided and coupled to bus 502 for storing information and instructions.

Computer system 500 may be coupled via bus 502 to a display 512, such as a liquid crystal display, for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. This input device typically has two degrees of freedom in two axes, a first axis (e.g., x) and a second axis (e.g., y), that allows the device to specify positions in a plane.

Computer system 500 may implement the techniques described herein using customized hard-wired logic, one or more ASICs or FPGAs, firmware and/or program logic which in combination with the computer system causes or programs computer system 500 to be a special-purpose machine. According to one embodiment, the techniques herein are performed by computer system 500 in response to processor 504 executing one or more sequences of one or more instructions contained in main memory 506. Such instructions may be read into main memory 506 from another storage medium, such as storage device 510. Execution of the sequences of instructions contained in main memory 506 causes processor 504 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 510. Volatile media includes dynamic memory, such as main memory 506. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 502. Transmission media can also take the form of acoustic or light waves, such as those generated during radio-wave and infra-red data communications.

Various forms of media may be involved in carrying one or more sequences of one or more instructions to processor 504 for execution. For example, the instructions may initially be carried on a magnetic disk or solid state drive of a remote computer. The remote computer can load the instructions into its dynamic memory and send the instructions over a telephone line using a modem. A modem local to computer system 500 can receive the data on the telephone line and use an infra-red transmitter to convert the data to an infra-red signal. An infra-red detector can receive the data carried in the infra-red signal and appropriate circuitry can place the data on bus 502. Bus 502 carries the data to main memory 506, from which processor 504 retrieves and executes the instructions. The instructions received by main memory 506 may optionally be stored on storage device 510 either before or after execution by processor 504.

Computer system 500 also includes a communication interface 518 coupled to bus 502. Communication interface 518 provides a two-way data communication coupling to a network link 520 that is connected to a local network 522. For example, communication interface 518 may be an integrated services digital network (ISDN) card, cable modem, satellite modem, or a modem to provide a data communication connection to a corresponding type of telephone line. As another example, communication interface 518 may be a local area network (LAN) card to provide a data communication connection to a compatible LAN. Wireless links may also be implemented. In any such implementation, communication interface 518 sends and receives electrical, electromagnetic or optical signals that carry digital data streams representing various types of information.

Network link 520 typically provides data communication through one or more networks to other data devices. For example, network link 520 may provide a connection through local network 522 to a host computer 524 or to data equipment operated by an Internet Service Provider (ISP) 526. ISP 526 in turn provides data communication services through the world wide packet data communication network now commonly referred to as the "Internet" 528. Local network 522 and Internet 528 both use electrical, electromagnetic or optical signals that carry digital data streams. The signals through the various networks and the signals on network link 520 and through communication interface 518, which carry the digital data to and from computer system 500, are example forms of transmission media.

Computer system 500 can send messages and receive data, including program code, through the network(s), network link 520 and communication interface 518. In the Internet example, a server 530 might transmit a requested code for an application program through Internet 528, ISP 526, local network 522 and communication interface 518.

The received code may be executed by processor 504 as it is received, and/or stored in storage device 510, or other non-volatile storage for later execution.

9. Equivalents, Extensions, Alternatives and Miscellaneous

In the foregoing specification, possible embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method comprising:

monitoring a calibration tone in a proximity to each of a listener's ears, the calibration tone being calibration sound waves emitted by two or more far-field speakers;

outputting one or more audio portions from two or more near-field speakers based on results of monitoring the calibration tone, the one or more audio portions canceling or reducing at least one of multi-channel cross talk and sound reflections from the two or more far-field speakers.

2. The method of claim 1, wherein the far-field speakers and the near-field speakers are controlled by a common audio processor.

3. The method of claim 1, wherein the far-field speakers are controlled by a far-field audio processor, wherein the near-field speakers are controlled by a near-field audio processor.

4. The method of claim 3, further comprising synchronizing the near-field audio processor with the far-field audio processor.

5. The method of claim 1, further comprising applying a signal processing algorithm to generate a surround ring that is separate from another surround-sound ring generated by the far-field speakers.

6. The method of claim 5, wherein the signal processing algorithm is part of an application downloaded to a device in the listener's proximity.

7. The method of claim 1, wherein the monitoring is in part performed by two or more microphones mounted in the listener's proximity.

8. The method of claim 7, wherein the microphones are mounted on a pair of glasses worn by the listener.

9. The method of claim 1, further comprising determining, based on the monitoring, one or more audio properties of far-field sound waves from the far-field speakers as perceived by the listener.

10. The method of claim 9, wherein the one or more audio properties comprise at least one of inter-aural level difference, inter-aural intensity difference, inter-aural time difference, or inter-aural phase difference.

11. The method of claim 1, further comprising determining, based on the monitoring, multi-channel cross talk and sound reflections related to far-field sound waves.

12. The method of claim 11, further comprising canceling or reducing at least one of multi-channel cross talk and sound reflections by outputting near-field sound waves obtained by inverting sound waves in the far-field sound waves.

13. The method of claim 1, wherein the calibration tone comprises sound waves at high sound wave frequencies beyond human hearing.

14. The method of claim 1, wherein the calibration tone comprises a plurality of pulses emitted by different ones of the far-end speakers at a plurality of different specific times.

15. The method of claim 1, wherein the near-field sound waves comprise at least one, two, or more audio cues indicating at least one distance of a sound source other than the far-field speakers, and wherein none of the at least one, two, or more audio cues are detectable from the far-field sound waves.

16. The method of claim 1, wherein the near-field sound waves comprise at least one, two or more audio cues generated with one or more audio processing filters and/or delays using a head-related transfer function.

17. The method of claim 1, further comprising interpolating near-field sound waves with the far-field sound waves to form a surround ring that is different from both a surround ring generated by the near-field speakers and a surround ring generated by the front-field speakers.

18. The method of claim 1, wherein at least one of the near-field speakers is operatively coupled to a mobile device that comprises an audio processing application to add a 3 dimensional (3D) spatial portion in a sound field perceived by the listener.

19. An audio system comprising:

a near-field audio processor configured to control two or more near-field speakers; and a far-field audio processor configured to control two or more far-field speakers and to output two or more far-field sound waves;

wherein the near-field audio processor is further configured to perform:

synchronizing with the far-field audio processing system;

monitoring, at each of two or more spatial locations adjacent to a listener, two or more calibration sound waves from the two or more far-field sound waves;

outputting two or more near-field sound waves based at least in part on results of the monitoring.

20. A non-transitory computer readable storage medium, comprising software instructions, which when executed by one or more processors cause performance of the method recited in claim 1.

* * * * *